US005567669A

United States Patent [19]

Harada et al.

[11] Patent Number: 5,567,669

[45] Date of Patent: Oct. 22, 1996

[54] THERMAL TRANSFER SHEET

[75] Inventors: Nobuyuki Harada; Hiroshi Eguchi, both of Tokyo-to, Japan

[73] Assignee: Dai Nippon Printing Co., Ltd., Japan

[21] Appl. No.: 404,818

[22] Filed: Mar. 14, 1995

[30] Foreign Application Priority Data

Mar. 17, 1994 [JP] Japan ..... 6-072742

[51] Int. Cl.[6] ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS 4,833,123 5/1989 Hashimoto et al. ..... 503/227

4,990,484 2/1991 Nakamura ..... 503/227

FOREIGN PATENT DOCUMENTS 0270677 6/1988 European Pat. Off. ..... 503/227

0323259 7/1989 European Pat. Off. ..... 503/227

0399673 11/1990 European Pat. Off. ..... 503/227

61-227092 10/1986 Japan ..... 503/227

*Primary Examiner*—Bruce H. Hess

*Attorney, Agent, or Firm*—Parkhurst, Wendel & Burr, L.L.P.

[57] ABSTRACT

The present invention provides a thermal transfer sheet having a color dye layer which has a reduced dye content and a good recording sensitivity and can provide an image having a good black color density. The thermal transfer sheet including a substrate sheet and, provided on the substrate sheet, a black dye layer including particular yellow, magenta, and cyan dyes.

5 Claims, 1 Drawing Sheet

THERMAL TRANSFER SHEET

BACKGROUND OF THE INVENTION

The present invention relates to a thermal transfer sheet and more particularly to a thermal transfer sheet which can provide a black image having excellent color density and various types of fastness.

Proposals have hitherto been made on methods wherein various full-color images could be formed on paper or a plastic film by a thermal transfer system using a sublimable dye. In these methods, a thermal head contained in a printer is used as heating means which transfers, by heating in a very short time, dots of three primary colors or four colors of black in addition to the three primary colors to a thermal transfer image-receiving sheet, thereby reproducing a full-color image of an original using the dots of a plurality of colors. Further, a single color, such as black, may be transferred to a thermal transfer image-receiving sheet to reproduce a monochrome image having a high gradation.

In the above thermal transfer system, since a dye is used as a colorant, the image formed is very sharp and highly transparent, offering excellent color reproduction and gradation of intermediate colors. Therefore, the quality of the image formed is equivalent to that of images formed by the conventional offset printing or gravure printing, and it is possible to form high-quality color images or monochrome images comparable to full-color photographic images.

Conventional thermal transfer sheets, for a black image, used in the thermal transfer system, however, cannot provide an image having excellent color density and various types of fastness because three primary colors, i.e., yellow, magenta, and cyan are combined in an improper manner.

DISCLOSURE OF THE INVENTION

Accordingly, an object of the present invention is to provide a thermal transfer sheet which can provide a black image having excellent color density and various types of fastness.

The above object can be attained by the following present invention. Specifically, the present invention relates to a thermal transfer sheet for a black image, comprising a substrate sheet and, provided on one side of said substrate sheet, a dye layer containing a plurality of dyes, said dyes contained in said dye layer being at least one yellow dye selected from those represented by the following general formulae (1), (2), and (3), at least one magenta dye selected from those represented by the following general formulae (4), (5), and (6), and at least one cyan dye selected from those represented by the following general formulae (7), (8), and (9):

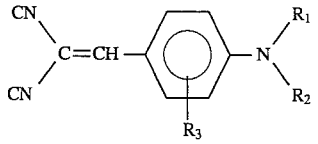

(1)

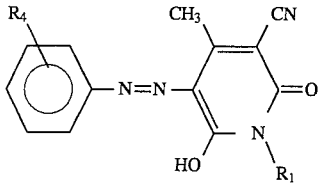

(2)

-continued

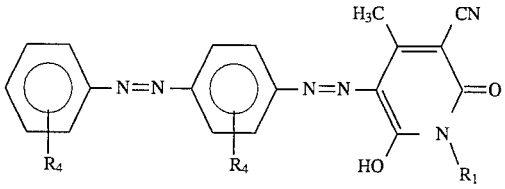

(3)

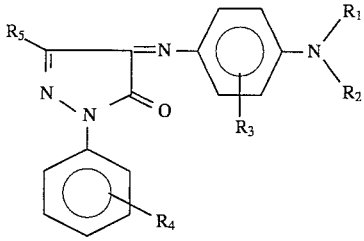

(4)

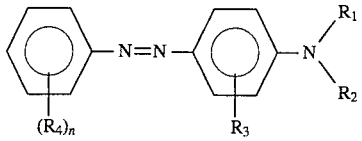

(5)

(wherein n is an integer of 3 or less)

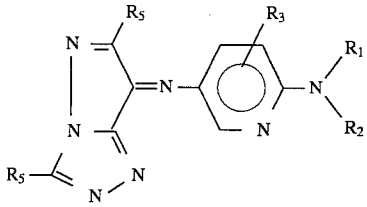

(6)

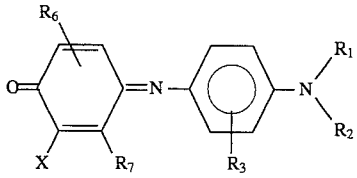

(7)

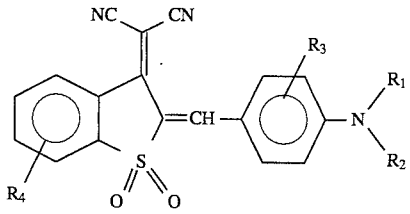

(8)

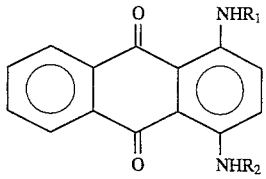

(9)

wherein $R_1$ and $R_2$ represent a substituted or unsubstituted alkyl group, a substituted or unsubstituted allyl group, a substituted or unsubstituted aryl group, a substituted or unsubstituted cycloalkyl group, a substituted or unsubstituted alkoxyalkyl group, or a substituted or unsubstituted aralkyl group, $R_3$ represents a substituted or unsubstituted alkyl group, a substituted or unsubstituted alkoxy group, a substituted or unsubstituted alkylcarbonylamino group, a substituted or unsubstituted alkylsulfonylamino group, a substituted or unsubstituted alkylaminocarbonyl group, a cyano group, a nitro group, a halogen atom, or a hydrogen atom, $R_4$ represents a substituted or unsubstituted alkyl group, a substituted or unsubstituted aralkyloxycarbonyl group, a substituted or unsubstituted alkoxycarbonyl group, a substituted or unsubstituted alkylaminocarbonyl group, a substituted or unsubstituted alkoxy group, a substituted or unsubstituted alkylaminosulfonyl group, a substituted or unsubstituted cycloalkyl group, a cyano group, a nitro group, a halogen atom, or a hydrogen atom, $R_5$ represents a substituted or unsubstituted alkyl group, a substituted or unsubstituted aryl group, a substituted or unsubstituted amino group, a substituted or unsubstituted cycloalkyl group, a cyano group, a nitro group, a halogen atom, or a hydrogen atom, $R_6$ represents a substituted or unsubstituted alkylaminocarbonyl group, a substituted or unsubstituted alkylaminosulfonyl group, a substituted or unsubstituted alkylcarbonylamino group, a substituted or unsubstituted alkylsulfonylamino group, or a halogen atom, $R_7$ represents a substituted or unsubstituted alkyl group, and X represents a halogen atom.

A thermal transfer sheet capable of providing a black image having excellent color density and various types of fastness can be provided by using particular dyes in combination.

BEST MODE FOR CARRYING OUT THE INVENTION

Figure 1:
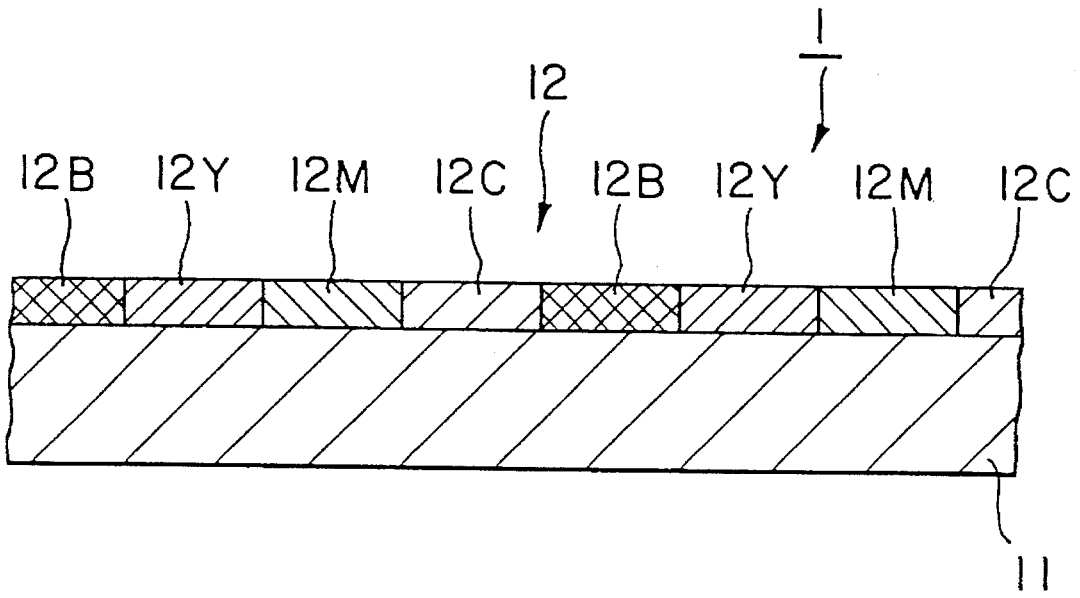
FIG. 1 is a schematic cross-sectional view of the thermal transfer sheet of the present invention.

Embodiments of the present invention will now be described with reference to the accompanying drawing.

FIG. 1 is a schematic cross-sectional view of the thermal transfer sheet of the present invention. In FIG. 1, a thermal transfer sheet 1 comprises a substrate sheet 11 and, provided on one side of the substrate sheet 11, a transfer dye layer 12 for each color. In the transfer dye layer 12, a yellow dye layer 12Y, a magenta dye layer 12M, a cyan dye layer 12C, and a black dye layer 12B are repeatedly arranged on the substrate sheet 11.

For each of the dye layer 12C, the dye layer 12M, the dye layer 12Y, and the dye layer 12B, the width thereof may be such as actually required in the formation of one image or such as determined by multiplying the width actually required in the formation of one image by an integral number and may be properly determined according to the size of an object image plane. Further, a thermal transfer sheet having a substrate sheet on one side of which the black dye layer alone is provided is a preferred embodiment of the present invention.

The substrate sheet 11 is not particularly limited, and any substrate sheet used in the conventional thermal transfer sheets, as such, may be used as the substrate sheet 11. Preferred examples thereof include plastic films of polyesters, polypropylene, cellophane, polycarbonates, cellulose acetate, polyethylene, polyvinyl chloride, polystyrene, nylon, polyimides, polyvinylidene chloride, polyvinyl alcohol, fluororesins, chlorinated rubber, and ionomers; papers, such as glassine paper, condenser paper, and paraffin paper; and nonwoven fabrics. Further, any composite of the above sheets may also be used as the substrate sheet.

The thickness of the substrate sheet may be properly determined so that required strength and thermal conductivity can be obtained, for example, may be about 3 to 100 μm.

As described above, a black dye layer 12B is formed, as one of the layers constituting the dye layer 12, on the substrate sheet. The black dye layer 12B is a layer formed by supporting a dye, having a black hue, prepared by mixing together a yellow dye, a magenta dye, and a cyan dye, which will be described later, on the substrate sheet by taking advantage of a binder.

The yellow dye contained in the black dye layer 12B of the present invention is at least one member selected from those represented by the following general formulae (1), (2), and (3):

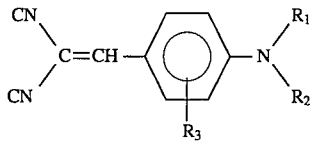

(1)

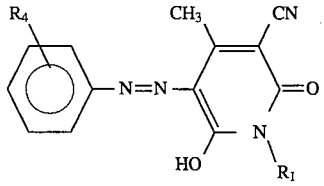

(2)

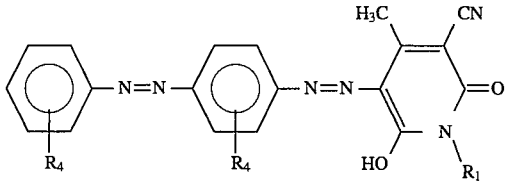

(3)

In the above general formula (1), $R_1$ and $R_2$ each independently represent a substituted or unsubstituted alkyl group, a substituted or unsubstituted allyl group, a substituted or unsubstituted aryl group, a substituted or unsubstituted cycloalkyl group, or a substituted or unsubstituted aralkyl group.

Specific examples of the substituents $R_1$ and $R_2$ include ethyl, 4-cyclohexylphenoxyethyl, n-butyl, phenyl, 2-propenyl, and benzyl groups. Among them, $R_1$=ethyl group and $R_2$=4-cyclohexylphenoxyethyl group are particularly preferred.

Further, in the above general formula (1), $R_3$ represents a hydrogen atom, a halogen atom, a substituted or unsubstituted alkyl group, a substituted or unsubstituted alkylcarbonylamino group, a substituted or unsubstituted alkylsulfonylamino group, a substituted or unsubstituted alkoxy group, a cyano group, or a nitro group.

Specific examples of the substituent $R_3$ include a chlorine atom, and methyl, ethyl, acetylamino, ethylsulfonylamino, and ethoxy groups. Among them, 3-$CH_3$ (i.e., a methyl group attached to the atom at the 3-position) is particularly preferred. As a general rule, the number of the substituent $R_3$ may be any possible one, that is, any of 1 to 4.

In the above general formula (2), $R_1$ represents a substituted or unsubstituted alkyl group, a substituted or unsubstituted aryl group, a substituted or unsubstituted allyl group, or a substituted or unsubstituted aralkyl group.

Specific examples of the substituent $R_1$ include ethyl, n-butyl, phenyl, 2-propenyl, and benzyl groups. Among them, n-$C_4H_9$ (n-butyl group) is particularly preferred. Further, in the above general formula (2), $R_4$ represents a substituted or unsubstituted alkyl group, a substituted or unsubstituted aralkyloxycarbonyl group, a substituted or unsubstituted alkoxycarbonyl group, a substituted or unsubstituted alkylaminocarbonyl group, a substituted or unsubstituted alkoxy group, a substituted or unsubstituted alkylaminosulfonyl group, a substituted or unsubstituted cycloalkyl group, a cyano group, a nitro group, a halogen atom, or a hydrogen atom.

Specific examples of the substituent $R_4$ include a chlorine atom and phenylmethoxycarbonyl, ethoxycarbonyl, methoxy, and ethyl groups. Among them, a phenylmethoxycarbonyl group attached to the atom at the 4-position is particularly preferred. As a general rule, the number of the substituent $R_4$ may be any possible one, that is, any of 1 to 5.

In the above general formula (3), $R_1$ represents a substituted or unsubstituted alkyl group, a substituted or unsubstituted aryl group, a substituted or unsubstituted allyl group, a substituted or unsubstituted aralkyl group, or a substituted or unsubstituted alkoxyalkyl group.

Particularly preferred examples of the substituent $R_1$ include methyl, n-butyl, phenyl, 2-propenyl, and benzyl groups, $—CH_2CH_2CH_2O(CH_3)_2$ and $—CH_2CH_2CH_2OCH(CH_3)_2$. Most preferred one is $—CH_2CH_2CH_2OCH(CH_3)_2$.

Further, in the above general formula (3), $R_4$ represents a substituted or unsubstituted alkyl group, a substituted or unsubstituted aralkyloxycarbonyl group, a substituted or unsubstituted alkoxycarbonyl group, a substituted or unsubstituted alkylaminocarbonyl group, a substituted or unsubstituted alkoxy group, a substituted or unsubstituted alkylaminosulfonyl group, a substituted or unsubstituted cycloalkyl group, a cyano group, a nitro group, a halogen atom, or a hydrogen atom.

Specific examples of the substituent $R_4$ include methyl and cyano groups and chlorine and hydrogen atoms. Among them, $R_4$=hydrogen atom is particularly preferred.

The content of such a yellow dye in the black dye layer is 5 to 50% by weight, still preferably 10 to 40% by weight, based on the dye composition of the black dye layer. When the content exceeds the upper limit, there occurs a problem that the hue does not become black although a change in composition to some extent gives rise to no significant deterioration in storage stability. The magenta dye contained in the black dye layer 12B of the present invention may comprise at least one magenta dye selected from those represented by the following general formulae (4), (5) and (6):

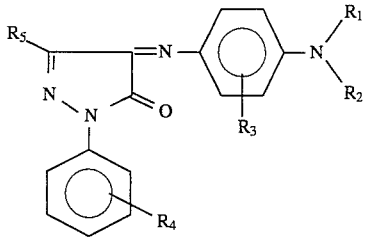

(4)

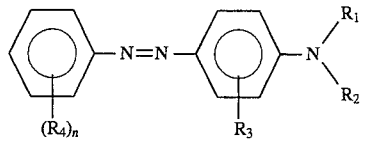

(5)

(wherein n is an integer of 3 or less)

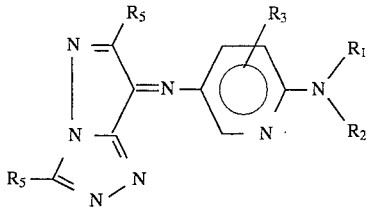

(6)

In the above general formula (4), $R_1$ and $R_2$ represent a substituted or unsubstituted alkyl group, a substituted or unsubstituted allyl group, a substituted or unsubstituted aryl group, a substituted or unsubstituted cycloalkyl group, or a substituted or unsubstituted aralkyl group.

Specific examples of the substituents $R_1$ and $R_2$ include ethyl, n-butyl, phenyl, cyclohexyl, 2-propenyl, and benzyl groups. Among them, $R_1$ =$R_2$=ethyl group is particularly preferred.

In the above general formula (4), $R_3$ represents a substituted or unsubstituted alkyl group, a substituted or unsubstituted alkoxy group, a substituted or unsubstituted alkylcarbonylamino group, a substituted or unsubstituted alkylsulfonylamino group, or a substituted or unsubstituted alkylaminocarbonyl group.

Specific examples of the substituent $R_3$ include methyl, ethyl, and methoxy groups, $—CONHC_3H_7$, $—NHCOCH_3$, and $—NHSO_2CH_3$. Among them, $R_3$=methyl group is particularly preferred.

In the above general formula (4), $R_4$ represents a substituted or unsubstituted alkyl group, a substituted or unsubstituted aralkyloxycarbonyl group, a substituted or unsubstituted alkoxycarbonyl group, a substituted or unsubstituted alkylaminocarbonyl group, a substituted or unsubstituted alkoxy group, a substituted or unsubstituted alkylaminosulfonyl group, a substituted or unsubstituted cycloalkyl group, a cyano group, a nitro group, a halogen atom, or a hydrogen atom.

Specific examples of the substituent $R_4$ include a hydrogen atom, a methyl group, $—NHCOCH_3$, and $—NHSO_2CH_3$. Among them, $R_4$=hydrogen atom is particularly preferred.

In the above general formula (4), $R_5$ represents a substituted or unsubstituted alkyl group, a substituted or unsubstituted aryl group, a substituted or unsubstituted amino group, a substituted or unsubstituted cycloalkyl group, a cyano group, a nitro group, a halogen atom, or a hydrogen atom.

Specific examples of the substituent $R_5$ include methyl, ethyl, and phenyl groups. Among them, $R_5$=methyl group is particularly preferred.

In the above general formula (5), $R_1$ and $R_2$ represent a substituted or unsubstituted alkyl group, a substituted or unsubstituted allyl group, a substituted or unsubstituted aryl group, a substituted or unsubstituted cycloalkyl group, or a substituted or unsubstituted aralkyl group.

Specific examples of the substituents $R_1$ and $R_2$ include ethyl, n-butyl, phenyl, 2-propenyl, and benzyl groups. Among them, $R_1$=ethyl group or benzyl group and $R_2$=ethyl group or 2-propenyl group are particularly preferred.

In the above general formula (5), $R_3$ represents a substituted or unsubstituted alkyl group, a substituted or unsubstituted alkoxy group, a substituted or unsubstituted alkylcarbonylamino group, a substituted or unsubstituted alkylsulfonylamino group, or a substituted or unsubstituted alkylaminocarbonyl group.

Specific examples of the substituent $R_3$ include methyl, ethyl, and methoxy groups, $—NHCOCH_3$, and —$NHSO_2CH_3$. Among them, $R_3$=—$NHSO_2CH_3$ or —$NHCOCH_3$ is particularly preferred.

In the above general formula (5), $R_4$ represents a substituted or unsubstituted alkyl group, a substituted or unsubstituted aralkyloxycarbonyl group, a substituted or unsubstituted alkoxycarbonyl group, a substituted or unsubstituted alkylaminocarbonyl group, a substituted or unsubstituted alkoxy group, a substituted or unsubstituted alkylaminosulfonyl group, a substituted or unsubstituted cycloalkyl group, a cyano group, a nitro group, a halogen atom, or a hydrogen atom.

Specific examples of the substituent $R_4$ include methyl, ethyl, methoxy, and cyclohexyl groups, —$SO_2NHCH_3$, cyano and nitro groups, and chlorine and hydrogen atoms. Among them, $R_4$=methyl, cyano, or nitro group or chlorine atom is particularly preferred.

In the above general formula (6), $R_1$ and $R_2$represent a substituted or unsubstituted alkyl group, a substituted or unsubstituted allyl group, a substituted or unsubstituted aryl group, a substituted or unsubstituted cycloalkyl group, or a substituted or unsubstituted aralkyl group.

Specific examples of the substituents $R_1$ and $R_2$ include ethyl, n-butyl, phenyl, cyclohexyl, 2-propenyl, and benzyl groups. Among them, $R_1$=$R_2$=ethyl group is particularly preferred.

In the above general formula (6), $R_3$ represents a substituted or unsubstituted alkyl group, a substituted or unsubstituted alkoxy group, a substituted or unsubstituted alkylcarbonylamino group, a substituted or unsubstituted alkylsulfonylamino group, or a substituted or unsubstituted alkylaminocarbonyl group.

Specific examples of the substituent $R_3$ include methyl, ethyl, and methoxy groups, —$NHCOCH_3$, and —$NHSO_2CH_3$. Among them, $R_3$=methyl group is particularly preferred.

In the above general formula (6), $R_5$ represents a substituted or unsubstituted alkyl group, a substituted or unsubstituted aryl group, a substituted or unsubstituted amino group, a substituted or unsubstituted cycloalkyl group, a cyano group, a nitro group, a halogen atom, or a hydrogen atom.

Specific examples of the substituent $R_5$ include methyl, phenyl, 3-methylphenyl, and tert-butyl groups. Among them, $R_5$=3-methylphenyl group or tert-butyl group is particularly preferred.

The content of such a magenta dye in the black dye layer is 5 to 50% by weight, still preferably 10 to 40% by weight, based on the dye composition of the black dye layer. When the content is outside the above range, as in the case of the above yellow dye, there occurs a problem that the hue does not become black although a change in composition to some extent gives rise to no significant deterioration in storage stability.

The cyan dye contained in the black dye layer 12B of the present invention may comprise at least one cyan dye selected from those represented by the following general formulae (7), (8), and (9):

(7)

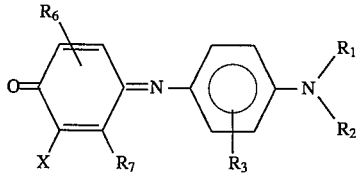

-continued (8)

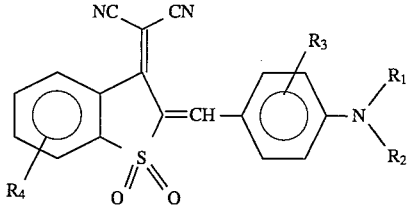

(9)

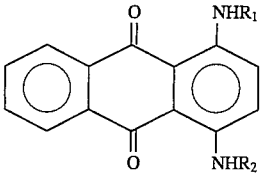

In the above general formula (7), $R_1$ and $R_2$ each independently represent a substituted or unsubstituted alkyl group, a substituted or unsubstituted allyl group, a substituted or unsubstituted aryl group, a substituted or unsubstituted cycloalkyl group, or a substituted or unsubstituted aralkyl group.

Specific examples of the substituents $R_1$ and $R_2$ include ethyl, n-butyl, 2-propenyl, and benzyl groups. Among them, $R_1$=$R_2$=ethyl group is particularly preferred.

Further, in the above general formula (7), $R_3$ represents a hydrogen atom, a halogen atom, a substituted or unsubstituted alkyl group, a substituted or unsubstituted alkylcarbonylamino group, a substituted or unsubstituted alkylsulfonylamino group, a substituted or unsubstituted alkoxy group, a cyano group, or a nitro group.

Specific examples of the substituent $R_3$ include a hydrogen atom, a methyl group, —$NHCOCH_3$, and —$NHSO_2CH_3$. Among them, $R_3$=methyl group or hydrogen atom is particularly preferred.

In the above general formula (7), $R_6$ represents a substituted or unsubstituted alkylaminocarbonyl group, a substituted or unsubstituted alkylaminosulfonyl group, a substituted or unsubstituted alkylcarbonylamino group, a substituted or unsubstituted alkylsulfonylamino group, or a halogen atom.

Specific examples of the substituent $R_6$ include —$CONHCH_3$, —$SO_2NHCH_3$, —$NHCOC_2H_5$, —$NHCOC_3H_7$, and —$NHSO_2CH_3$. Among them, $R_3$=—$NHCOCH_3$, —$NHCOC_3H_7$, or —$NHCOC_3H_7$ is particularly preferred.

In the above general formula (7), $R_7$ represents a substituted or unsubstituted alkyl group, a cyano group, a nitro group, a halogen atom, or a hydrogen atom.

Specific examples of the substituent $R_7$ include methyl and ethyl groups and chlorine and hydrogen atoms. Among them, $R_7$=methyl group or hydrogen atom is particularly preferred.

In the above general formula (7), X represents a halogen atom or a hydrogen atom.

In the above general formula (8), $R_1$ and $R_2$ represent a substituted or unsubstituted alkyl group, a substituted or unsubstituted aryl group, a substituted or unsubstituted cycloalkyl group, or a substituted or unsubstituted aralkyl group.

Specific examples of the substituents $R_1$ and $R_2$ include n-butyl, n-hexyl, phenyl, 2-propenyl, and benzyl groups. Among them, $R_1$=$R_2$=n-$C_6H_{13}$ (n-hexyl group) is particularly preferred.

In the above general formula (8), $R_3$ represents a substituted or unsubstituted alkyl group, a substituted or unsubstituted alkoxy group, a substituted or unsubstituted alkylcarbonylamino group, a substituted or unsubstituted alkylsulfonylamino group, or a substituted or unsubstituted alkylaminocarbonyl group.

Specific examples of the substituent $R_3$ include a chlorine atom and methyl, ethyl, acetylamino, ethylsulfonylamino, and ethoxy groups. Among them, 3-$CH_3$ (a methyl group attached to the atom at the 3-position) is particularly preferred. As a general rule, the number of the substituent $R_3$ may be any possible one, that is, any of 1 to 4.

In the above general formula (8), $R_4$ represents a substituted or unsubstituted alkyl group, a substituted or unsubstituted aralkyloxycarbonyl group, a substituted or unsubstituted alkoxycarbonyl group, a substituted or unsubstituted alkylaminocarbonyl group, a substituted or unsubstituted alkoxy group, a substituted or unsubstituted alkylaminosulfonyl group, a substituted or unsubstituted cycloalkyl group, a cyano group, a nitro group, a halogen atom, or a hydrogen atom.

Specific examples of the substituent $R_4$ include methyl and ethyl groups, —$CONHCH_3$, —$SO_2NHCH_3$, cyano and nitro groups, and halogen and hydrogen atoms. Among them, $R_4$=hydrogen atom is particularly preferred.

In the above general formula (9), $R_1$ and $R_2$ represent a substituted or unsubstituted alkyl group, a substituted or unsubstituted allyl group, a substituted or unsubstituted aryl group, a substituted or unsubstituted cycloalkyl group, or a substituted or unsubstituted aralkyl group.

Specific examples of the substituents $R_1$ and $R_2$ include methyl, 3-methylphenyl, n-butyl, phenyl, 2-propenyl, and benzyl groups. Among them, $R_1$=—$CH_3$ (methyl group) and $R_2$=3-methylphenyl group are particularly preferred.

The content of the above cyan dye in the black dye layer is 30 to 75% by weight, still preferably 40 to 70% by weight, based on the dye composition of the black dye layer. When the content is outside the above range, as in the case of the above yellow dye and magenta dye, there occurs a problem that the hue does not become black although a change in composition to some extent gives rise to no significant deterioration in storage stability.

The black dye layer 12B contains a binder in addition to the above dyes. Any known resin binder may be used as the binder. Preferred examples thereof include cellulosic resins, such as ethyl cellulose, hydroxyethyl cellulose, ethyl hydroxyethyl cellulose, hydroxypropyl cellulose, methyl cellulose, cellulose acetate, and cellulose butyrate, vinyl resins, such as polyvinyl alcohol, polyvinyl acetate, polyvinyl butyral, polyvinyl acetal, polyvinyl acetoacetal, polyvinyl pyrrolidone, and polyacrylamide, and polyesters. Among them, cellulosic, acetal, butyral, and polyester resins are particularly preferred from the viewpoint of the heat resistance, migration of dyes, and the like.

In the present invention, the total amount of the dyes added to the ink for the dye layer of the transfer sheet can be reduced as compared with that in the prior art, which enables the amount of the dye incorporated in the ink layer to be in a wide range of from about 0.5 to 3.0 in terms of D/B ratio wherein D represents the weight of the dye and B represents the weight of the binder. This in turn enables the print density and the storage stability to be enhanced to a desired extent according to the applications of the transfer sheet.

The black dye layer of the present invention basically comprises the above materials and, if necessary, may further comprise known various additives in such an amount as will not be detrimental to the object of the present invention. Such additives include those described in European Patent Nos. 133011, 133012, and 111004.

The above dye layer may be formed by preparing a coating solution (an ink) in the form of a solution or a dispersion of the above dyes, binder resin, and other additional components, coating the coating solution on a substrate sheet, and drying the resulting coating. The thickness of the dye layer thus formed is in the range of from about 0.1 to 10 μm, preferably in the range of from about 0.2 to 3.0 μm. The content on a solid basis of the above dye component in the black dye layer is in the range of from 20 to 80% by weight, preferably in the range of from 40 to 70% by weight.

Organic fine particles, such as polyethylene wax, inorganic fine particles, and the like may be incorporated into the black dye layer from the viewpoint of the regulation of the coatability and the prevention of fusing between the dye layer and the image-receiving sheet.

An anti-blocking layer, that is, a release layer, may be provided on the black dye layer. The release layer may be a deposit of an inorganic powder having an anti-blocking property or a layer of a resin having excellent releasability, such as a silicon polymer, an acrylic polymer, or a fluoropolymer. The above materials having excellent releasability can exhibit a good effect also when they are incorporated into the dye layer.

Further, a heat-resistant layer may be provided on the back surface of the thermal transfer sheet from the viewpoint of avoiding the adverse effect of heat from a thermal head. The heat-resistant layer may be, for example, a layer containing a product of a reaction of polyvinyl butyral with an isocyanate, a surfactant, such as an alkali metal salt or alkaline earth metal salt of a phosphoric ester, and a filler, such as talc.

Dyes contained in the yellow dye layer 12Y, the magenta dye layer 12M, and the cyan dye layer 12C usually provided, in addition of the above black dye layer 12B, on the substrate sheet 11 are not particularly limited and may be those used in the conventional thermal transfer sheet. As mentioned above, the black color type thermal transfer sheet according to the present invention has good sensitivity and gives a high color density. Hence, the thermal transfer sheet of the present invention is highly suitable for thermal printing of characters and margin images where high density printing is required. In particular, in proof printing, black images having excellent color reproducibility and a high density can be obtained by the use of the present invention.

The thermal transfer sheet of the present invention is used in such a manner that thermal energy is applied to the thermal transfer sheet by means of a thermal head through the back side of the thermal transfer sheet to transfer color dots of three or four colors to an image-receiving paper (material on which an image is to be transferred), thus forming a full-color image on the image-receiving paper (material on which an image is to be transferred). The image-receiving paper (material on which an image is to be transferred) comprises a substrate and, provided thereon, the so-called "receptive layer" which serves to receive a sublimable dye and hold the formed picture elements. Resins for forming the receptive layer include, for example, polyolefin resins, such as polypropylene, halogenated polymers, such as polyvinyl chloride and polyvinylidene chloride, vinyl polymers, such as polyvinyl acetate and polyacrylic esters, polyester resins, such as polyethylene terephthalate and polybutylene terephthalate, polystyrene resins, polyamide resins, resins of copolymers of olefins, such as ethylene and propylene, with other vinyl monomers, ionomers, cellulosic resins, such as cellulose diacetate, and polycarbonates.

The receptive layer may be formed by dissolving or dispersing the above resin containing necessary additives in a suitable solvent to prepare an ink, coating the ink on a substrate by known means, and drying the resultant coating.

Pigments and fillers, such as titanium oxide, zinc oxide, kaolin clay, calcium carbonate, and finely divided silica, may be used as the additives incorporated in the receptive layer from the viewpoint of improving the whiteness of the receptive layer to further enhance the sharpness of a transferred image or improving the releasability of the receptive layer.

The present invention will now be described in more detail with reference to the following examples.

EXAMPLES

Sixteen in total of dyes, i.e., 12 dyes used in the present invention, represented by the following formulae (Y1) to (M3), and comparative magenta dyes, yellow dye, and cyan dye represented respectively by the following formulae (**M*1), (M*2), (Y*1), and (C*1**), were prepared:

(Y-1) (C.I. Disperse Yellow 281)

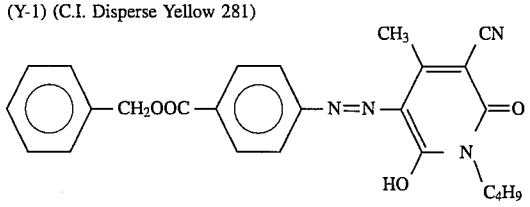

(Y-2) (C.I. Disperse Yellow 201)

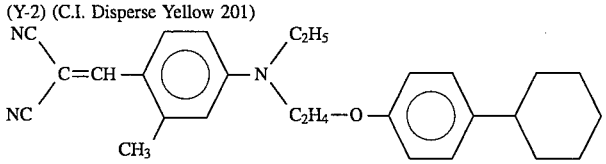

(Y-3) (C.I. Disperse Orange 149)

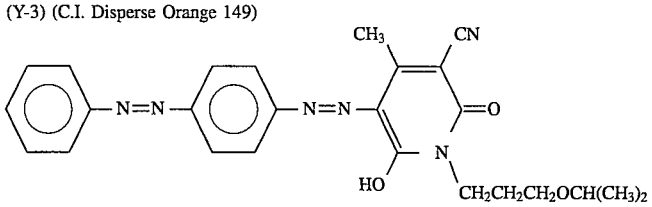

(M-1) (Cas. No. 118914-87-7)

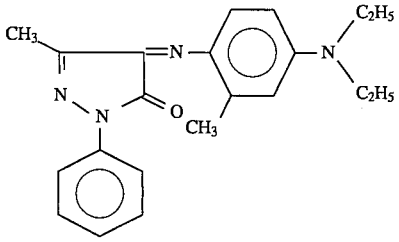

(M-2)

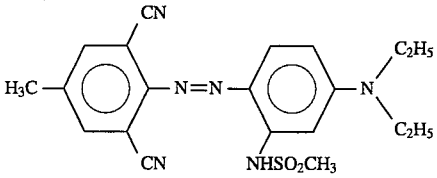

(M-3)

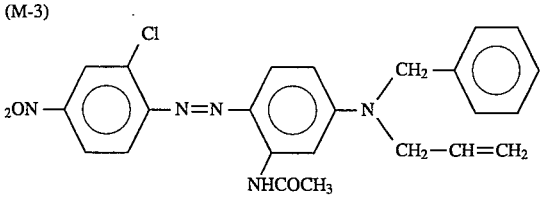

-continued
(M-4)
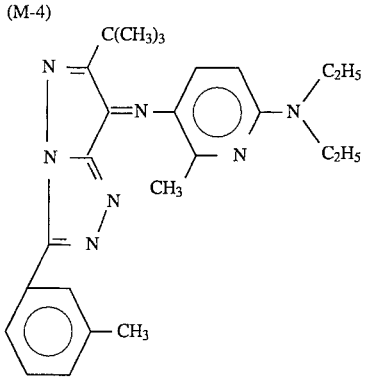
(C-1)
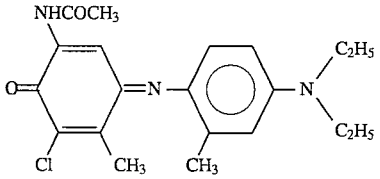
(C-2) (Cas. No. 121187-07-3)
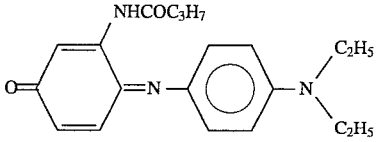
(C-3) (Cas. No. 113415-87-0)
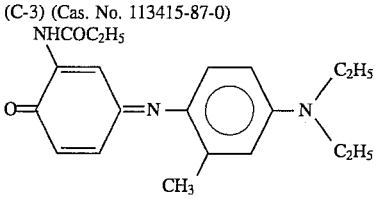
(C-4) (C.I. Solvent Blue 63)
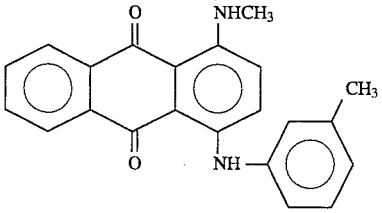
(C-5) (C.I. Disperse Blue 354)
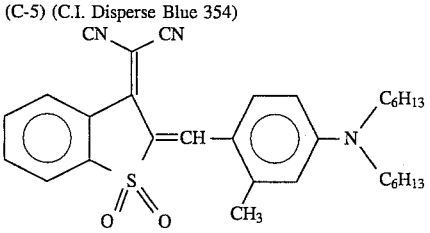
(M*1)
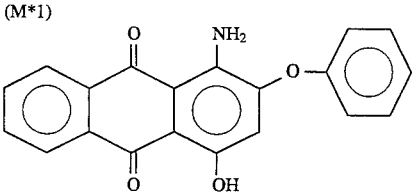

-continued (M*2)

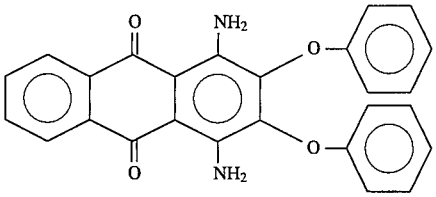

(Y*1)

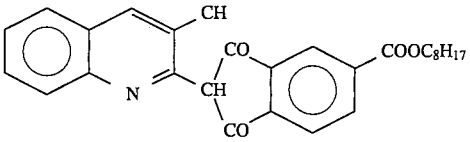

(C*1)

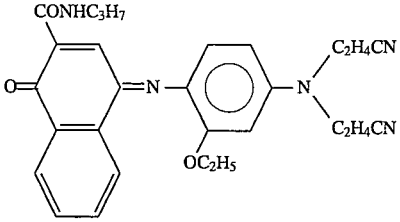

These dyes may be properly combined to prepare black dyes as listed in the following Table 1.

TABLE 1

Mixing proportions of dyes in the preparation of black dyes

| Black dye layer No. | No. 1 | No. 2 | No. 3 | No. 4 | No. 5 |
|---|---|---|---|---|---|
| Dye Y-1 | | | | | |
| Y-2 | 1.75 | 1.10 | 1.26 | | |
| Y-3 | | | | 2.05 | 2.80 |
| M-1 | | | | | 0.80 |
| M-2 | 2.10 | | 0.63 | | |
| M-3 | | 2.15 | | 1.55 | |
| M-4 | | | 0.70 | | |
| C-1 | 2.52 | 3.30 | 3.50 | | |
| C-2 | | | | | 3.40 |
| C-3 | | | | 3.40 | |
| C-4 | | | 0.91 | | |
| C-5 | 0.63 | 0.45 | | | |

| Black dye layer No. | No. 6 | No. 7 | No. 8 | No. 9 | No. 10 |
|---|---|---|---|---|---|
| Dye Y-1 | | 1.60 | | | |
| Y-2 | 1.43 | | 0.38 | 1.42 | 2.00 |
| Y-3 | | 1.40 | 1.20 | 1.41 | |
| M-1 | | | | 1.50 | |
| M-2 | 1.43 | | 1.12 | | |
| M-3 | | | | | |
| M-4 | | 1.40 | | | 2.10 |
| C-1 | | 1.60 | 1.05 | | 2.10 |
| C-2 | | 1.50 | | 1.67 | |
| C-3 | | | | 1.50 | |
| C-4 | 4.64 | | 3.75 | | |
| C-5 | | | | | 1.50 |

| Black dye layer No. | No. 11 | No. 12 | No. 13 | No. 14 |
|---|---|---|---|---|
| | | Comparative Example | | |
| Dye Y-1 | | 1.40 | | |
| Y-2 | 1.40 | | | 1.20 |
| Y-3 | | | | |
| M-1 | | | | |
| M-2 | | | 1.60 | |
| M-3 | | | | |
| M-4 | 1.40 | | | 1.20 |
| C-1 | 0.50 | | | |
| C-2 | | | | |
| C-3 | | | | |
| C-4 | 4.40 | 4.00 | 4.00 | |
| C-5 | | | | |
| M*1 | | 1.30 | | |
| M*2 | | 1.30 | | |
| Y*1 | | | 2.40 | |
| C*1 | | | | 5.60 |

In the above Table 1 , the numerical vales are in parts by weight.

Ink compositions for forming black dye layer 12B were prepared using various black dyes prepared above, a polyvinyl acetoacetal resin as a binder, toluene as a solvent, methyl ethyl ketone, and the like according to the following formulations.

| Ink compositions 1 to 5 for black dye layer: | |
|---|---|
| Black dye Nos. 1 to 5 (Table 1) | 7.00 parts |
| Polyvinyl acetoacetal resin (Eslec KS-5, manufactured by Sekisui Chemical Co., Ltd.) | 3.50 parts |
| Toluene | 44.75 parts |
| Methyl ethyl ketone | 44.75 parts |
| **Ink compositions 6 to 9 for black dye layer:** | |
| Black dye Nos. 6 to 9 (Table 1) | 7.50 parts |
| Polyvinyl acetoacetal resin (Eslec KS-5, manufactured by Sekisui Chemical Co., Ltd.) | 3.50 parts |
| Toluene | 44.50 parts |
| Methyl ethyl ketone | 44.50 parts |
| **Ink compositions 10 and 11 for black dye layer:** | |
| Black dye Nos. 10 and 11 (Table 1) | 7.70 parts |
| Polyvinyl acetoacetal resin | 3.50 parts |

-continued

| | |
|---|---|
| (Eslec KS-5, manufactured by Sekisui Chemical Co., Ltd.) | |
| Toluene | 44.40 parts |
| Methyl ethyl ketone | 44.40 parts |
| Ink compositions 12 to 14 for black dye layer: | |
| Black dye Nos. 12 to 14 (Table 1) | 8.00 parts |
| Polyvinyl acetoacetal resin (Eslec KS-5, manufactured by Sekisui Chemical Co., Ltd.) | 3.50 parts |
| Toluene | 44.25 parts |
| Methyl ethyl ketone | 44.25 parts |

These ink compositions were coated on a 6.0 μm-thick substrate sheet of polyethylene terephthalate which had been subjected to a treatment for rendering the sheet heat-resistant and lubricious (6CF53, manufactured by Toray Industries, Inc.) at a coverage on a dry basis of 1.2 g/m$^2$, and the resultant coatings were dried to prepare thermal transfer sheet samples having the above various black dye layers. The thermal transfer sheet sample No. corresponds to the above black dye No. (Table 1). Then, an image-receiving paper was prepared as follows.

| Preparation of image-receiving paper: | |
|---|---|
| Polyester resin (VYLON 600, manufactured by Toyobo Co., Ltd.) | 4.0 parts |
| Vinyl chloride/vinyl acetate copolymer (#1000A, manufactured by Denki Kagaku Kogyo K.K.) | 6.0 parts |
| Amino-modified silicone oil (X-22-3050C, manufactured by The Shin-Etsu Chemical Co., Ltd) | 0.2 part |
| Epoxy-modified silicone oil (X-22-3000E, manufactured by The Shin-Etsu Chemical Co., Ltd) | 0.2 part |
| Methyl ethyl ketone | 44.8 parts |
| Toluene | 44.8 parts |

A coating solution, for forming an image-receptive layer, having the above composition was coated on one side of synthetic paper (Yupo FPG150, manufactured by Oji-Yuka Synthetic Paper Co., Ltd.) as a substrate, and the resultant coating was dried to prepare an image-receiving paper (coverage of receptive layer: 4.5 g/m$^2$ on a dry basis).

Printing was actually carried out on this image-receiving paper using the thermal transfer sheets having a black dye layer prepared above to evaluate the thermal transfer sheets for the following items.

(1) Relative sensitivity

Sixteen-gradation printing was carried out at a constant applied voltage with varied application time (maximum applied energy: 100 mJ/mm$^2$ at a pulse width of 16 msec). Based on the results of printing, the applied energy (printing time) was plotted as abscissa against the optical density (O.D. value) as ordinate to prepare the so-called "γcurve," and a printing energy which provides an optical density of 1.0 was determined for a comparative sample (sample No. 12). Then, the optical densities at this printing energy for individual samples according to examples of the present invention (sample Nos. 1 to 11) were determined to relatively evaluate the optical density values.

(2) Maximum density of black

The maximum density at the printed area was measured with RD918 manufactured by Macbeth. In this case, 16-gradation printing (maximum applied energy: 100 mJ/mm$^2$ at a pulse width of 16 msec) was carried out under conditions of a printing interval of 33.3 msec/line, a pulse width of 1 to 16 msec/line, an applied voltage of 11.0 V (a constant voltage), and varied application time. Based on the results of printing, the applied energy (printing time) was plotted as abscissa against the optical density (O.D. value) as ordinate to prepare the so-called "γcurve," and the maximum optical density was determined as the maximum density.

TABLE 2

| Thermal transfer sheet sample No. | Experimental results: Relative sensitivity | Max. density |
|---|---|---|
| No. 1 | 1.12 | 2.38 |
| No. 2 | 1.13 | 2.43 |
| No. 3 | 1.12 | 2.40 |
| No. 4 | 1.15 | 2.51 |
| No. 5 | 1.20 | 2.60 |
| No. 6 | 1.10 | 2.28 |
| No. 7 | 1.15 | 2.48 |
| No. 8 | 1.18 | 2.57 |
| No. 9 | 1.21 | 2.66 |
| No. 10 | 1.24 | 2.68 |
| No. 11 | 1.20 | 2.63 |
| No. 12 (Comparative Example) | 1.00 | 1.98 |
| No. 13 (Comparative Example) | 0.98 | 1.95 |
| No. 14 (Comparative Example) | 0.95 | 1.90 |

The above results clearly demonstrate the effect of the present invention. Specifically, since the black dye layer of the thermal transfer sheet according to the present invention contains a dye having a black hue, prepared by selecting particular dyes and mixing the selected dyes together, the thermal transfer sheet of the present invention has the effect of making it possible to lower the dye content of the dye layer and, at the same time, to provide a good printing sensitivity and a high black color density.

I claim:

1. A thermal transfer sheet for a black image, comprising a substrate sheet and, provided on one side of said substrate sheet, a black dye layer containing a plurality of dyes, said dyes contained in said black dye layer being at least one yellow dye selected from those represented by the following general formulae (1), (2), and (3), at least one magenta dye selected from those represented by the following general formulae (4), (5), and (6), and at least one cyan dye selected from those represented by the following general formulae (7), (8), and (9):

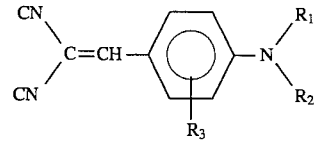

(1)

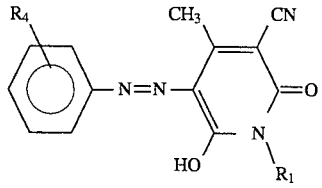

(2)

-continued (3)

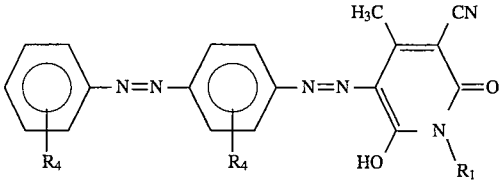

(4)

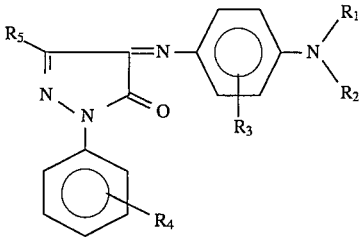

(5)

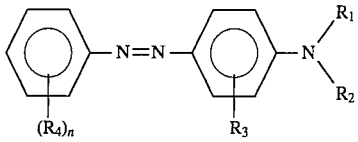

wherein n is an integer of 3 or less, (6)

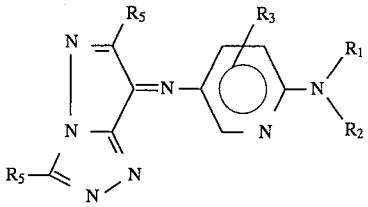

(7)

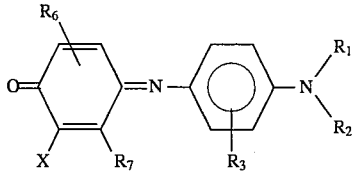

(8)

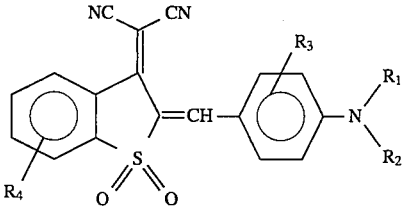

-continued (9)

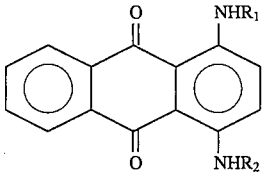

wherein $R_1$ and $R_2$ represent a substituted or unsubstituted alkyl group, a substituted or unsubstituted allyl group, a substituted or unsubstituted aryl group, a substituted or unsubstituted cycloalkyl group, a substituted or unsubstituted aralkyl group, or a substituted or unsubstituted alkoxyalkyl group, $R_3$ represents a substituted or unsubstituted alkyl group, a substituted or unsubstituted alkoxy group, a substituted or unsubstituted alkylcarbonylamino group, a substituted or unsubstituted alkylsulfonylamino group, a substituted or unsubstituted alkylaminocarbonyl group, a cyano group, a nitro group, a halogen atom, or a hydrogen atom, $R_4$ represents a substituted or unsubstituted alkyl group, a substituted or unsubstituted aralkyloxycarbonyl group, a substituted or unsubstituted alkoxycarbonyl group, a substituted or unsubstituted alkylaminocarbonyl group, a substituted or unsubstituted alkoxy group, a substituted or unsubstituted alkylaminosulfonyl group, a substituted or unsubstituted cycloalkyl group, a cyano group, a nitro group, a hydrogen atom or a halogen atom, $R_5$ represents a substituted or unsubstituted alkyl group, a substituted or unsubstituted aryl group, a substituted or unsubstituted amino group, a substituted or unsubstituted cycloalkyl group, a cyano group, a nitro group, a halogen atom, or a hydrogen atom, $R_6$ represents a substituted or unsubstituted alkylaminocarbonyl group, a substituted or unsubstituted alkylaminosulfonyl group, a substituted or unsubstituted alkylcarbonylamino group, a substituted or unsubstituted alkylsulfonylamino group, or a halogen atom, $R_7$ represents a substituted or unsubstituted alkyl group, and X represents a halogen atom.

2. The thermal transfer sheet according to claim 1, wherein the dyes contained in said black dye layer are at least one yellow dye selected from those represented by the following formulae Y-1, Y-2, and Y-3, at least one magenta dye selected from those represented by the following formulae M-1, M-2, M-3, and M-4, and at least one cyan dye selected from those represented by the following formulae C-1, C-2, C-3, C-4, and C-5:

Y-1

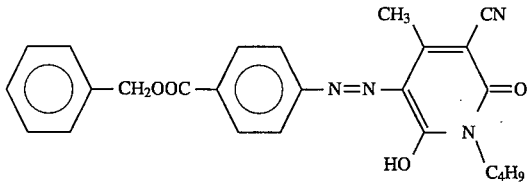

Y-2

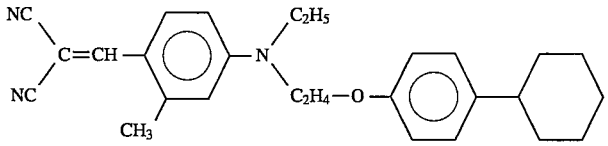

-continued
Y-3
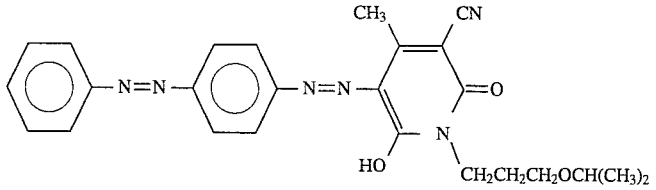
M-1
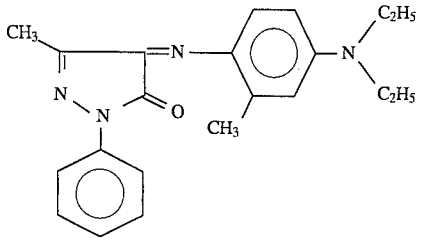
M-2
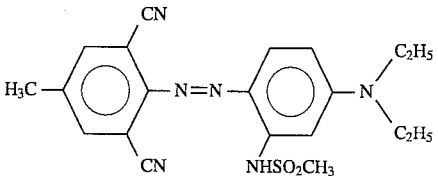
M-3
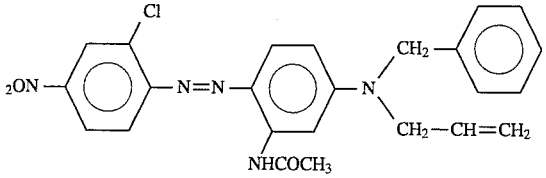
M-4
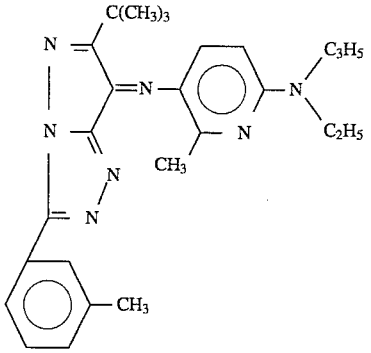
C-1
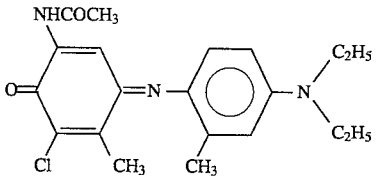
C-2
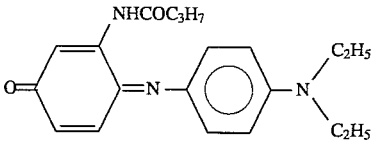
C-3
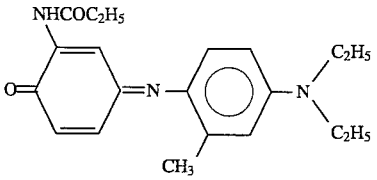

-continued

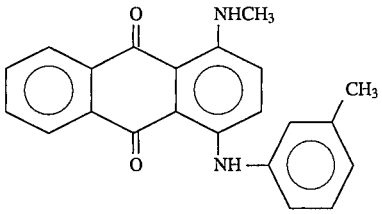

C-4

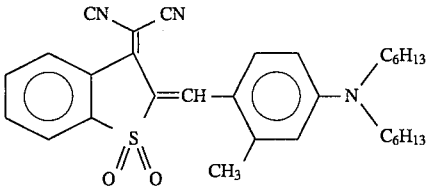

C-5

3. The thermal transfer sheet according to claim 2, wherein at least one dye contained in said dye layer is selected from the group consisting of the yellow dye Y-2, magenta dye M-2, cyan dye C-1 and cyan dye C-4.

4. The thermal transfer sheet according to claim 1 wherein the proportions, based on the dye composition of said dye layer, of said yellow dye, said magenta dye, and said cyan dye contained in said dye layer are 10 to 40% by weight for said yellow dye, 10 to 40% by weight for said magenta dye, and 40 to 70% by weight for said cyan dye.

5. The thermal transfer sheet according to claim 1, wherein said transfer sheet further comprises, in addition to said black dye layer, at least one separate dye layer of at least one of magenta dye, yellow dye and cyan dye.

* * * * *